US010871022B2

(12) United States Patent
Ben-Arie

(10) Patent No.: US 10,871,022 B2
(45) **Date of Patent: *Dec. 22, 2020**

(54) SLIDING WINDOW MECHANISM II

(71) Applicant: Jezekiel Ben-Arie, Carlsbad, CA (US)

(72) Inventor: Jezekiel Ben-Arie, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/423,164

(22) Filed: May 28, 2019

(65) Prior Publication Data

US 2019/0277077 A1 Sep. 12, 2019

Related U.S. Application Data

(63) Continuation-in-part of application No. 15/448,775, filed on Mar. 3, 2017, now Pat. No. 10,344,521.

(60) Provisional application No. 62/303,386, filed on Mar. 4, 2016.

(51) Int. Cl.

| | |
|---|---|
| ***E05F 15/67*** | (2015.01) |
| ***E05D 15/16*** | (2006.01) |
| *E05F 15/689* | (2015.01) |
| *E05F 15/41* | (2015.01) |

(52) U.S. Cl.

CPC ..... *E05F 15/67* (2015.01); *E05D 15/165* (2013.01); *E05F 15/41* (2015.01); *E05F 15/689* (2015.01)

(58) Field of Classification Search

CPC ..... E05F 15/67; E05F 15/689; E05F 11/42; E05F 11/423

See application file for complete search history.

(56) References Cited

U.S. PATENT DOCUMENTS

| | | | | | |
|---|---|---|---|---|---|
| 1,339,879 | A * | 5/1920 | Cima | E05F 11/42 | 49/136 |
| 2,538,329 | A * | 1/1951 | Roos | E05F 11/423 | 49/119 |
| 2,649,301 | A * | 8/1953 | Signore | E05F 11/42 | 49/279 |
| 3,219,335 | A * | 11/1965 | Burridge | E05F 11/382 | 49/360 |
| 4,182,078 | A * | 1/1980 | Bartholomew | E05F 11/405 | 49/140 |
| 4,293,752 | A * | 10/1981 | Koenig | H01H 3/142 | 174/117 A |

(Continued)

FOREIGN PATENT DOCUMENTS

| | | | | |
|---|---|---|---|---|
| FR | 385037 A | * | 4/1908 | E05F 11/42 |
| GB | 478975 A | * | 1/1938 | E05F 11/423 |

*Primary Examiner* — Marcus Menezes

(57) ABSTRACT

A mechanism for vertically sliding a windowed frame in one track alongside a static frame installed in a second track. The mechanism consists of two vertical racks installed on the sliding frame, which engage with two pinions coupled with a joint axle which are installed within the lower horizontal plank of the static frame. Turning the joint axle turns also the pinions which move the frame vertically. There are two options for turning the joint axle. The manual option involves turning a crank, the electrical option involves an electric motor coupled with a gearbox. The electrical option also includes a control unit for controlling the direction and speed of the sliding, two limit switches for stopping the frame at highest and lowest positions, an electrical overload sensor which detects sudden sliding obstructions and a burglar alarm. The sliding frame also includes four rollers which reduce the sliding friction.

11 Claims, 3 Drawing Sheets

(56) References Cited

U.S. PATENT DOCUMENTS

| | | | | | |
|---|---|---|---|---|---|
| 4,402,160 | A * | 9/1983 | Brusasco | E05F 11/426 | 49/352 |
| 4,414,778 | A * | 11/1983 | Carli | E05F 15/67 | 49/199 |
| 4,783,048 | A * | 11/1988 | St. Clair | F16K 3/0281 | 251/129.11 |
| 4,899,492 | A * | 2/1990 | Szerdahelyi | E05F 11/382 | 49/349 |
| 5,440,837 | A * | 8/1995 | Piltingsrud | E05D 15/22 | 49/139 |
| 6,085,825 | A * | 7/2000 | Swink | B60J 5/08 | 160/133 |
| 6,343,436 | B1 * | 2/2002 | Milano, Jr. | E05F 15/67 | 49/362 |
| 10,370,887 | B2 * | 8/2019 | Lange | E05D 13/006 | |
| 2003/0196383 | A1 * | 10/2003 | Fenelon | E05F 11/385 | 49/349 |
| 2006/0075685 | A1 * | 4/2006 | Gustafson | E05F 11/405 | 49/349 |

* cited by examiner

SLIDING WINDOW MECHANISM II

CROSS-REFERENCE TO RELATED APPLICATIONS

This Application is a Continuation in Part of application Ser. No. 15/448,775 Filed on Mar. 3, 2017

This Application claims priority from a Provisional Patent Application: Ser. No. 62/303,386 filed on Mar. 4, 2016

FEDERALLY SPONSORED RESEARCH

Not Applicable.

SEQUENCE LISTING OR PROGRAM

Not Applicable.

TECHNICAL FIELD

The present invention relates to sliding window mechanisms.

PRIOR ART

Many mechanisms were invented for sliding windows especially for sliding windows of vehicles. Usually sliding windows have a framed glass pane. The sliding frame slides between two parallel guides which are attached to the walls and are part of the window's static outer frame. When a window is sliding horizontally, the parallel guides are also horizontal. In the case that the windows are sliding vertically, the parallel guides are vertical. However, we could not find a sliding window mechanism which employs a motorized balanced system of two pinions which are coupled with the same axis and are engaged with two racks attached to the opposite sides of a sliding window frame. Almost all of the other sliding window mechanisms were designed for horizontal sliding and all of them are using a motorized single cable which is attached to the lower side of the sliding frame in a push-pull or a pull-pull mechanism. In a push-pull mechanism one end of the cable is connected to one of the two lower corners of the sliding frame and moves the sliding frame by pushing it in one horizontal direction or pulling it in opposite direction. This push-pull mechanism requires a thick and stiff cable which does not bend when it pushes the sliding frame. In the pull-pull mechanism the two ends of the cable are connected to the two lower corners of the sliding frame and the window is moved by pulling one corner for one direction or pulling the opposite corner for the opposite direction. This mechanism is more efficient because it requires only pulling which can be implemented with much thinner cable.

We have found many other patents which dealt with mechanisms for sliding windows but none is similar to our invention. These patents are listed here: U.S. Pat. No. 6,125,585 to Koneval et al. (Oct. 3, 2000) teaches a push-pull system for horizontal sliding window for cars. There, the cable is connected only at one lower side of the window. U.S. Pat. No. 6,766,617 to Purcell (Jul. 27, 2004) teaches a horizontal sliding window assembly with pull-pull cable mechanism attached to the lower side of the window. U.S. Pat. No. 5,822,922 to Grumm et al. (Oct. 20, 1998) teaches a horizontal sliding window assembly with push-pull 2-cable mechanism attached to the lower side of two sliding windows. U.S. Pat. No. 6,026,611 Ralston et al. (Feb. 22, 2000) teaches a horizontal sliding window assembly with pull-pull cable mechanism attached to the lower side of the window. U.S. Pat. No. 5,784,833 to Sponable et al. (Jul. 28, 1998) teaches a horizontal sliding window assembly with pull-pull cable mechanism attached to the lower side of the window. US 2014/0352600 to Erskine et al. (Dec. 4, 2014) teaches a windshield sliding window/door assembly which uses a single cable attached to one side of the window. US 2004/0094990 Castellon (May 20, 2004) Teaches a car widow assembly which employs a single motorized cable to move the pane. U.S. Pat. No. 9,233,734 Erskine et al. (Jan. 12, 2016) teaches a windshield sliding window/door assembly which uses a single cable attached to one side of the window. U.S. Pat. No. 6,324,788 Koneval et al. (Dec. 4, 2001) teaches a push-pull system for horizontal sliding window for cars. US 2015/0298528 Lahnala (Oct. 22, 2015) teaches a horizontal sliding window assembly with pull-pull cable mechanism attached to the lower side of the window. US 2007/0277443 Dery et al. (Dec. 6, 2007) teaches a horizontal sliding window assembly with push-pull cable mechanism attached to the lower side of the window. US 2012/0091113 Bennett et al. (Apr. 19, 2012) teaches a horizontal sliding window assembly with pull-pull cable mechanism attached to the lower side of the window. US 2010/0122496 Lahnala (May 20, 2010) teaches a horizontal sliding window assembly with pull-pull cable mechanism attached to the lower side of the window. US 2004/0025439 Purcell (Feb. 2, 2004) teaches a horizontal sliding window assembly with pull-pull cable mechanism attached to the lower side of the window.

None of the Patents and Patent applications described above is similar to our invention.

BRIEF SUMMARY OF THE INVENTION

Our invention includes a mechanism for opening and closing a sliding window. Our mechanism is especially suited for vertical sliding windows which usually require excessive physical effort in opening and closing. A sliding window comprises a pane made of transparent material, which is installed in a sliding frame. The sliding frame includes a left vertical plank, a right vertical plank, a lower horizontal plank and an upper horizontal plank. The frame is sliding within an outer frame which has two parallel vertical guides facing one the other. Each guide includes two parallel tracks one beside the other. In each guide, one track guides the sliding frame in moving up or down. A static frame is also installed in the second track. The static frame also has a pane and it is installed in the second track within the guides in the outer frame such that the sliding frame can slide alongside the static frame in the first track. The mechanism for moving the sliding window consists of two parallel rack and pinion mechanisms. The two racks are teethed strips which can be attached along the inner side of the left and right vertical planks of the sliding frame. The left and right pinions are teethed gearwheels that fit the teethed racks. The left and the right pinions are coupled with the same axle (named as the joint axle) and are turning at the same speed. The left pinion is engaged with the left rack and the right pinion is engaged with the right rack. Since the two racks have equal number of teeth per unit length and the pinions have equal number of teeth per unit angle, the left and right racks are moved up or down at the same speed when the joint axle is being turned. Thus, the sliding window mechanism is designed to provide a balanced propulsion i.e. to push the left side of the frame with the same force as the right side. Unbalanced propulsion such as having only one sided rack and pinion, generates an unwanted turning force on the frame, which may result in a jerky window motion. The appearance of the whole mechanism does not differ from the appearance of non-mechanized sliding window because the mechanism is hidden in a recess in the lower horizontal plank of the static frame.

There are two options to operate the sliding mechanism. In the manual option the sliding mechanism is driven by turning a crank which causes the joint axle to turn and move the sliding window up or down. Depending on the mechanical load, the crank can be connected to a crank gearbox which amplifies the output torque. In the second option the sliding mechanism is driven by an electric motor connected to a motor gearbox which amplifies its torque output. This enables to drive larger and heavier sliding frames.

The sliding frame also includes four rollers which are installed at four recesses made in the vertical sliding planks sides facing the tracks that guide the sliding frame in moving up or down. The rollers are actually small wheels with axles which are installed in the recesses and protrude above their recesses only with small part of each wheel which engages with the guiding track. Since the rollers prevent direct engagement of the sliding frame's vertical planks with the guiding track, they significantly reduce the mutual friction between the sliding frame and the guiding tracks and facilitate smoother frame sliding.

In the electric motorized option the electrical system also includes a control unit that enables the user to control the direction and the speed of the sliding motion. In addition, the electrical system is also connected to two limit switches, installed in the upper and lower parts of the outer frame. The limit switches are configured to signal the control unit to stop the sliding frame when it reaches its highest position and when it reaches its lowest position.

The control unit which controls the motor is also equipped with a safety circuit which includes an electrical overload sensor which can detect a sudden overload of the motor's current. Such an overload happens when the window is in the process of closing and it hits an obstruction of a person or an object. Thus, when the load circuit detects an obstruction it instructs the control unit to reverse the motor which then opens the window.

The electrical system also provides a burglar alarm circuit, which sounds the alarm when the sliding frame is forced open while the alarm system is armed. Unlike regular sliding windows, the mechanized sliding window does not need a locking latch because it requires very high force to reverse the mechanical system in order to open the window from outside.

The sliding mechanism has two mechanical options for connecting the joint axle with the crank or with the geared electrical motor. In first option the right end of the joint axle is coupled with the left end of the first axle which is also coupled with a first bevel gearwheel at the first axle right end. The first bevel gearwheel engages a second bevel gearwheel connected to the crank. Alternatively, the first bevel gearwheel can be engaged with a third bevel gearwheel attached to the motor's output gear's axle.

In the second mechanical option the first axle is replaced by a bended axle which is coupled at its left end with the right end of the joint axle. The bended axle is elastic and can be bended while turning and its right end can be moved to the location where it can be coupled with a crank gearbox output axle or with a motor output gearbox axle. The crank gearbox output axle is the output axle of a gearbox which is connected at its input to a crank axle. The motor gearbox output axle is the output axle of a gearbox which is connected at its input to an electrical motor. The bended axle is guided by a bendable guiding tube, which can be bended and allow the bended axle to rotate in a wide range of arcs.

BRIEF DESCRIPTION OF THE DRAWINGS

FIG. 1 describes the bevel gear option of the mechanism.

FIG. 2 describes the bended axle option of the mechanism.

DETAILED DESCRIPTION OF THE DRAWINGS

Figure 1:
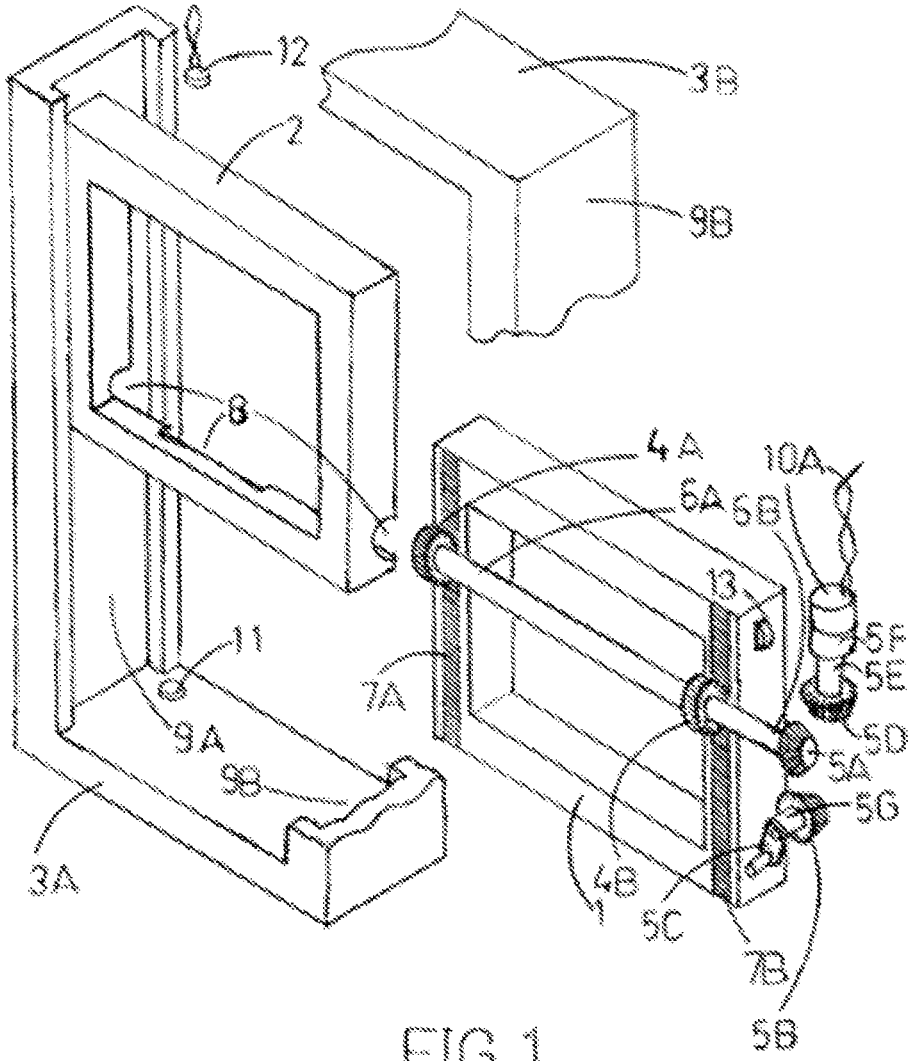
FIG. 1 illustrates in 3D isometric drawing a disassembled view of the entire sliding window mechanism.

FIG. 1 illustrates in 3D isometric drawing a disassembled view of the entire sliding window mechanism. FIG. 1 describes the bevel gear option of the mechanism.

The sliding frame 1 is depicted separately from the static frame 2. The static frame 2 is installed between the outer frame right vertical guide 9B and the left outer frame vertical guide 9A which is connected to the lower outer horizontal bar 3A and to the upper outer horizontal bar 3B. To allow better viewing, the rest of the outer frame is depicted in pieces. The opposite outer frame's right vertical guide 9B is shown in two pieces where one piece is connected to the outer frame upper horizontal bar 3B and the second piece of outer frame's right vertical guide 9B is connected to the outer frame lower horizontal bar 3A. The static frame 2 also has also has at its lower static horizontal plank 2D a recess 8 which is used to house the joint axle 6A which is fused to the left pinion 4A at its left end and to the right pinion 4B at its right end. The joint axle 6A is also coupled at its right end with the left end of the first axle 6B. The right end of the first axle 6B is coupled with the first bevel gearwheel 5A. The first bevel gearwheel 5A can be engaged with the second bevel gearwheel 5B or with the third bevel gearwheel 5C. The second bevel gearwheel 5B is connected with the crank axle 5G which is attached to the crank 5C. The third bevel gearwheel 5D is connected to the motor gearbox output axle 5E at it lower end where at its upper end it is connected with the motor gearbox 5F. The motor gearbox 5F is mechanically coupled with the electric motor 10A.

The left pinion 4A is engaged with the left rack 7 which is installed on the inner side of the vertical left sliding plank of the sliding frame 1. The right pinion 4B is engaged with the right rack 7 which is installed on the inner side of the vertical right sliding plank of the sliding frame 1. Two out of four rollers 13 (only one roller is shown in FIG. 1) are installed at two recesses made at the left side of the vertical left sliding plank of the sliding frame and the other two rollers are installed at two recesses made at the right side of the vertical right sliding plank of the sliding frame.

Thus, turning the crank 5C turns the crank axle 5G and the second bevel gearwheel 5B. Turning the second bevel gearwheel 5B which engages with the first bevel gearwheel 5A turns it and also turns the first axle 6B, the right pinion 4B, the joint axle 6A and the left pinion 4A. The left and right turning pinions move vertically the racks 7 and the attached sliding frame 1.

In addition, turning the electric motor 10A turns the motor gearbox 5F, turns the motor gearbox output axle 5E and the third bevel gearwheel 5D. Turning the third bevel gearwheel 5D which engages with the first bevel gearwheel 5A turns it and also turns the first axle 6B, the right pinion 4B, the joint axle 6A and the left pinion 4A. The left and right turning pinions move vertically the racks 7 and the attached sliding frame 1.

A lower limit switch 11 and an upper limit switch 12 are electrically connected to the control unit and facilitate stopping the sliding frame at its lowest and highest positions respectively.

Figure 2:
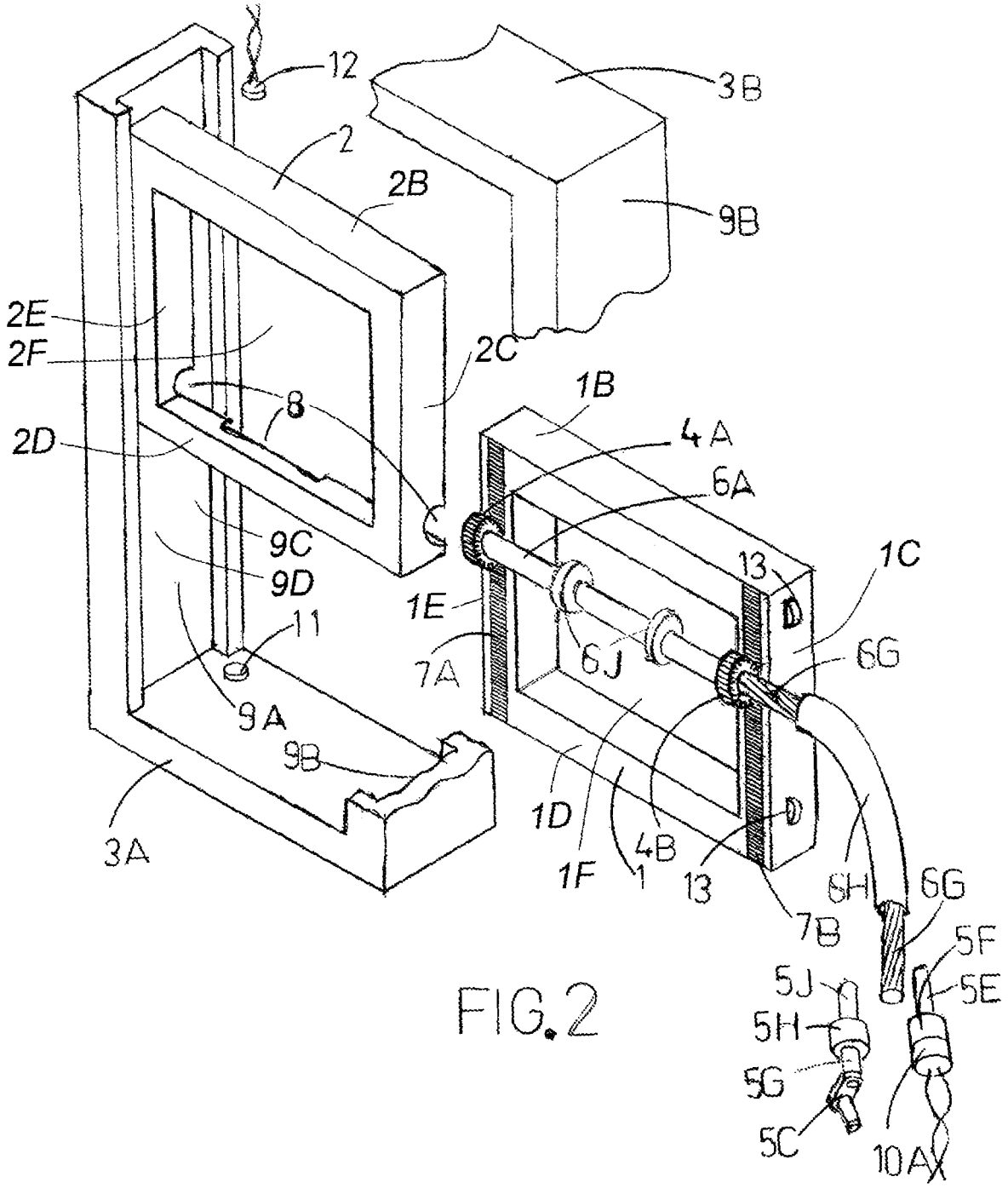
FIG. 2 illustrates in 3D isometric drawing a disassembled view of the entire sliding window mechanism.

FIG. 2 illustrates in 3D isometric drawing a disassembled view of the entire sliding window mechanism. FIG. 2 describes the bended axle option of the mechanism.

The sliding frame 1 is depicted separately from the static pane 2F which is framed by the static frame 2. The static window 2 i.e. the static frame 2, includes the left vertical static plank 2E, the right vertical static plank 2C, lower horizontal static plank 2D and the upper horizontal static plank 2B. The sliding frame 1 which holds the sliding pane 1F is composed of the left vertical sliding plank 1E, the right vertical sliding plank 1C, upper horizontal sliding plank 1B and the lower horizontal sliding plank 1D. The static frame 2 is installed between the outer frame right vertical guide 9B and the left outer frame vertical guide 9A which is connected to the lower outer horizontal bar 3A and to the upper outer horizontal bar 3B. To allow better viewing, the rest of the outer frame is depicted in pieces. The opposite outer frame's right vertical guide 9B is shown in two pieces where one piece is connected to the outer frame upper horizontal bar 3B and the second piece of outer frame's right vertical guide 9B is connected to the outer frame lower horizontal bar 3A. The outer frame right vertical guide 9B and the left outer frame vertical guide 9A are divided into the first and second tracks 9C and 9D respectively. The static frame 2 also has at its lower static horizontal plank, a recess 8 which is used to house the joint axle 6A which is fused to the left pinion 4A at its left end and to the right pinion 4B at its right end. If necessary, one could hold the joint axle 6A also with a pair of bearings 6J attached to the static frame 2. The joint axle 6A is also coupled at its right end with the left end of the bended axle 6G. The right end of the bended axle 6G can be coupled with the crank gearbox axle 5J or with the motor gearbox output axle 5E. The crank gearbox 5H is connected with the crank axle 5G which is attached to the crank 5C. The motor gearbox output axle 5E is connected to the motor gearbox 5F. The motor gearbox 5F is mechanically coupled with the electric motor 10A. The bended axle 6G is guided by a guiding tube 6H which is bendable. The guiding tube 6H can be bended in a range of arcs and can guide the bended axle 6G to operate i.e. turn in a range of bended arcs. This option enables one to place the crank gearbox axle 5J or the motor gearbox output axle 5E which are coupled with the bended axle 6G, at different locations.

The left pinion 4A is engaged with the left rack 7 which is installed on the inner side of the left vertical sliding plank of the sliding frame 1. The right pinion 4B is engaged with the right rack 7 which is installed on the inner side of the right vertical sliding plank of the sliding frame 1. Two out of four rollers 13 (only two rollers are shown in FIG. 2) are installed at two recesses made at the left side of the vertical left sliding plank of the sliding frame and the other two rollers are installed at two recesses made at the right side of the vertical right sliding plank of the sliding frame.

Thus, turning the crank 5C turns the crank axle 5G the crank gearbox 5H and the crank gearbox axle 5J. Turning the crank gearbox axle 5J which is coupled with the right end of the bended axle 6G turns it and also turns the joint axle 6A which is fused at its left end to the right end of the bended axle 6G. Turning the joint axle 6A also turns the right pinion 4B and the left pinion 4A. The left and right turning pinions move vertically the racks 7 and the sliding frame 1 which is attached to the racks.

In addition, turning the electric motor 10A turns the motor gearbox 5F and turns the motor gearbox output axle 5E along with the bended axle 6G which is attached at its right end to the motor gearbox output axle 5E. Turning the bended axle 6G which is attached at its left end to the right end of the joint axle 6A, turns also the right pinion 4B, the joint axle 6A and the left pinion 4A. The left and right turning pinions move vertically the racks 7 and the attached sliding frame 1.

A lower limit switch 11 and an upper limit switch 12 are electrically connected to the control unit and facilitate stopping the sliding frame at its lowest and highest positions respectively.

Figure 3:
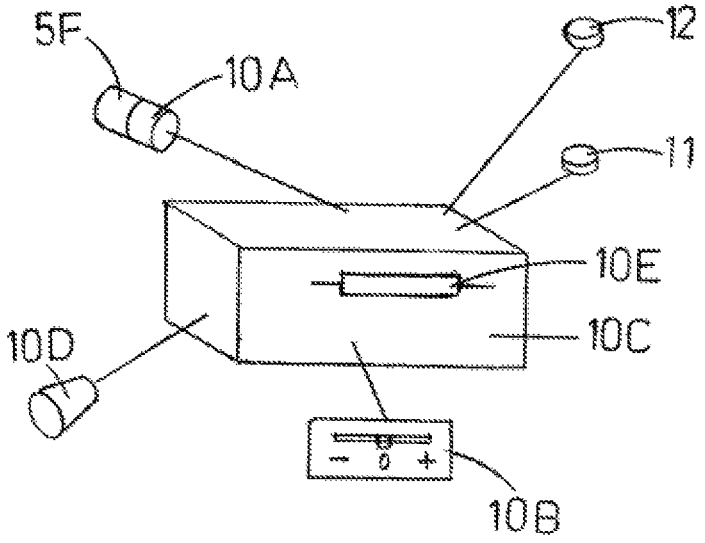
FIG. 3 depicts the electrical control system.

FIG. 3 depicts the electrical control system 10C. In the electric motorized option the electrical system also includes a control unit 10B that enables the user to control the direction and speed of the sliding motion. In addition, the electrical option includes two limit switches 11 and 12 which are installed in the outer frame. Limit switch 12 stops the sliding frame when it reaches its highest position and limit switch 11 stops the sliding frame when it reaches its lowest position.

The control unit which controls the motor is equipped a safety circuit which includes an electrical overload sensor 10E which can detect a sudden overload of the motor's 10A current. Such an overload happens when the sliding window is in the process of closing and it hits an obstruction of a person or an object. Thus, when the load circuit 10E detects an obstruction it instructs the control unit to reverse the motor 10A which then opens the window.

The electrical system also provides a burglar alarm circuit, which sounds the alarm 10D when the sliding frame 1 is forced open while the alarm system is armed.

What is claimed is:

1. A window mechanism configured for opening and closing a sliding window comprising: an outer frame, a static window, a joint axle, a bended axle; a left pinion and a right pinion;

the sliding window comprising: a sliding frame, a sliding pane, a left rack, a right rack; wherein the sliding pane is made of transparent material and is configured to be framed within the sliding frame;

the sliding frame is constructed from a left vertical sliding plank, a right vertical sliding plank, a lower horizontal sliding plank and an upper horizontal sliding plank;

wherein the left rack is installed on an inner side of the left vertical sliding plank;

wherein the right rack is installed on an inner side of the right vertical sliding plank;

the static window comprising: a static frame, a static pane; wherein said static pane is made of transparent material and configured to be framed within said static frame;

wherein the static frame is constructed from a left vertical static plank, a right vertical static plank, a lower horizontal static plank and an upper horizontal static plank;

wherein the lower horizontal static plank has a recess which is configured to house the left pinion, the joint axle and the right pinion;

the outer frame comprises: a left vertical guide, a right vertical guide, a lower horizontal outer bar and an upper horizontal outer bar;

wherein said left vertical guide is parallel to the right vertical guide; wherein said left vertical guide is facing the right vertical guide; wherein the left vertical guide and the right vertical guide both include a first track and a second track; wherein the first track is parallel to the second track;

wherein the first track is configured to guide the sliding frame in sliding up and down within the outer frame;

wherein the static frame is installed in the second track; wherein a top side of the upper horizontal static plank is attached to a bottom side of the upper outer horizontal bar;

wherein the joint axle is coupled with the left pinion at a joint axle left end;

wherein the joint axle is coupled with the right pinion at a joint axle right end;

wherein, turning the joint axle also turns the left pinion and the right pinion;

wherein the left pinion is engaged with the left rack and the right pinion is engaged the right rack;

wherein the right rack and the sliding frame are configured to being vertically moved by turning the right pinion;

wherein the left rack and the sliding frame are configured to being vertically moved by turning the left pinion;

wherein, a single turn of the left pinion is configured to displace the left rack by a unit left displacement;

wherein, a single turn of the right pinion is configured to displace the right rack by a unit right displacement;

wherein the unit right displacement is configured to be equal to the unit left displacement;

wherein moving the sliding window up and down is facilitated by turning the joint axle;

wherein the joint axle right end is coupled with a bended axle left end;

wherein turning the bended axle is configured to turn the right pinion, the joint axle and the left pinion.

2. The window mechanism of claim 1, wherein the sliding frame further comprising: a lower left roller, an upper left roller, a lower right roller and an upper right roller;

wherein the upper left roller is installed at an upper left side of the left vertical sliding plank;

wherein the lower left roller is installed at a lower left side of the left vertical sliding plank;

wherein the upper right roller is installed at an upper right side of the right vertical sliding plank;

wherein the lower right roller is installed at a lower right side of the right vertical sliding plank;

wherein, the upper left roller, the lower left roller, the upper right roller and the lower right roller facilitate sliding of the sliding frame within said outer frame.

3. The window mechanism of claim 2, wherein the lower left roller, the upper left roller, the lower right roller and the upper right roller are installed in recesses.

4. The window mechanism of claim 1, wherein said window mechanism further comprising: a guiding tube, a motor gearbox and an electrical motor mechanically coupled with the motor gearbox;

wherein the bended axle is elastic and bendable;

wherein the bended axle is guided by the guiding tube;

wherein the guiding tube is bendable;

wherein the joint axle right end is coupled with the bended axle left end;

wherein the motor gearbox includes a motor gearbox output axle which is coupled with a bended axle right end;

wherein, activating the electrical motor is configured to turn the motor gearbox output axle and to turn the bended axle; wherein turning the bended axle is configured to turn the right pinion, the joint axle and the left pinion;

wherein, activating the electrical motor facilitates moving vertically the sliding window.

5. The window mechanism of claim 4, wherein said window mechanism further comprising: a control unit;

wherein the electrical motor is electrically connected to the control unit;

wherein the control unit controls a direction of the electrical motor and a speed of the electrical motor; wherein the control unit is electrically connected to a control box by which a user can manually control the direction of the electrical motor and the speed of the electrical motor;

wherein the electrical motor is configured to move the sliding window up or down by turning the motor gearbox output axle.

6. The window mechanism of claim 4, comprising: a lower limit switch and an upper limit switch; wherein said lower limit switch is configured to be activated when said sliding frame reaches a lowest position within said outer frame;

wherein said upper limit switch is configured to be activated when said sliding frame reaches a highest position within said outer frame;

wherein said lower limit switch and said upper limit switch are electrically connected to a control unit; wherein said control unit is configured to stop said electrical motor when said lower limit switch or said upper limit switch is activated.

7. The window mechanism of claim 6, further comprising: a burglar alarm electrically connected to said control unit;

wherein said lower limit switch is configured to activate said burglar alarm when said lower limit switch is deactivated and said burglar alarm is armed.

8. The window mechanism of claim 6, further comprising: an overload sensor electrically connected to said control unit; wherein said control unit is configured to reverse the direction of said electrical motor when said overload sensor senses a sudden overload of said electrical motor due to a blocking of said sliding window.

9. The window mechanism of claim 1, wherein said window mechanism further comprising: a guiding tube, a crank, a crank axle, a crank gearbox and a crank gearbox axle;

wherein the bended axle is elastic and bendable;

wherein the bended axle is guided by the guiding tube;

wherein the guiding tube is bendable;

wherein the joint axle right end is coupled with the bended axle left end;

wherein the crank is mechanically coupled with the crank axle;

wherein the crank axle is mechanically coupled with a crank gearbox input;

wherein the crank gearbox axle is mechanically coupled with a crank gearbox output;

wherein the crank gearbox axle is coupled with a bended axle right end;

wherein, turning the crank is configured to turn the crank axle, to turn the crank gearbox axle and to turn the bended axle; wherein turning the bended axle is configured to turn the right pinion, the joint axle and the left pinion;

wherein, turning the crank facilitates turning of the left pinion and the right pinion;

wherein, turning the crank facilitates moving vertically the sliding window.

10. The window mechanism of claim 1, wherein said window mechanism further comprising:

a crank and a crank axle;

wherein the bended axle is elastic and bendable;

wherein the bended axle is guided by a guiding tube;

wherein the guiding tube is bendable;

wherein the joint axle right end is coupled with the bended axle left end;

wherein the crank is coupled with a crank axle right end;

wherein a crank axle left end is coupled with a bended axle right end;

wherein, turning the crank is configured to turn the crank axle and to turn the bended axle; wherein turning of the bended axle is configured to turn the right pinion, to turn the joint axle and to turn the left pinion;

wherein, turning the crank facilitates turning of the left pinion and the right pinion;

wherein, turning the crank facilitates moving vertically the sliding window.

11. The window mechanism of claim 1, wherein said window mechanism further comprising:

a pair of bearings attached to the static frame and supporting the joint axle.

* * * * *